US011540608B2

(12) United States Patent
Barber

(10) Patent No.: US 11,540,608 B2
(45) Date of Patent: Jan. 3, 2023

(54) EYELASH CURLER

(71) Applicant: Cindy Jane Barber, Vermont (AU)

(72) Inventor: Cindy Jane Barber, Vermont (AU)

(73) Assignee: Cindy Jane Barber, Vermont (AU)

( * ) Notice: Subject to any disclaimer, the term of this patent is extended or adjusted under 35 U.S.C. 154(b) by 1060 days.

(21) Appl. No.: 15/516,239

(22) PCT Filed: Oct. 1, 2014

(86) PCT No.: PCT/AU2014/050263
§ 371 (c)(1),
(2) Date: Mar. 31, 2017

(87) PCT Pub. No.: WO2015/054743
PCT Pub. Date: Apr. 23, 2015

(65) Prior Publication Data
US 2017/0295902 A1 Oct. 19, 2017

(51) Int. Cl.
*A45D 2/48* (2006.01)

(52) U.S. Cl.
CPC ..... *A45D 2/48* (2013.01)

(58) Field of Classification Search
CPC . A45D 1/00; A45D 2/48; A45D 40/30; A45D 44/00; A41G 5/02
USPC ..... D28/36, 55
See application file for complete search history.

(56) References Cited

U.S. PATENT DOCUMENTS 1,847,401 A * 3/1932 Klein ..... A45D 2/00 132/148
2,635,611 A 4/1953 Marcellus
3,547,135 A * 12/1970 Roos ..... A41G 5/02 132/216
3,556,113 A * 1/1971 Frieder ..... A41G 5/02 132/216
3,640,290 A * 2/1972 Theis ..... A45D 2/48 132/217
3,722,519 A * 3/1973 Epstein ..... A41G 5/02 D28/36
5,307,826 A 5/1994 Iosilevich
(Continued)

FOREIGN PATENT DOCUMENTS

CN 205030680 U 2/2016
EP 0081020 A1 6/1983
(Continued)

OTHER PUBLICATIONS

International Search Report dated Nov. 26, 2014, for copending International application No. PCT/AU2014/050263.

*Primary Examiner* — Nicholas D Lucchesi
*Assistant Examiner* — Jennifer Gill
(74) *Attorney, Agent, or Firm* — Warner Norcross + Judd LLP

(57) ABSTRACT

There is disclosed an eyelash curler comprising an upper section which comprises at least one edge and a lower section which comprises an eyelash support portion, the curler being operable such that eyelashes can be clamped between the edge and the support portion, whereby the edge extends transverse to the eyelashes and engages a top side thereof, and, while the eyelashes remain so clamped, the edge can be drawn along said top side, substantially in the direction in which each of the lashes extends, whereby the eyelashes are curled upwardly.

11 Claims, 4 Drawing Sheets

(56) References Cited

U.S. PATENT DOCUMENTS

| | | | | | |
|---|---|---|---|---|---|
| 5,377,700 | A | * | 1/1995 | Harris | A45D 2/48 132/216 |
| D395,733 | S | * | 6/1998 | Ishida | D28/36 |
| 6,026,825 | A | * | 2/2000 | de Laforcade | A45D 40/265 132/218 |
| D515,242 | S | * | 2/2006 | Cho | D28/36 |
| D631,605 | S | * | 1/2011 | Cho | D28/36 |
| 2002/0189628 | A1 | * | 12/2002 | Losilevich | A45D 2/48 132/217 |
| 2005/0061347 | A1 | | 3/2005 | Park | |

FOREIGN PATENT DOCUMENTS

| | | | |
|---|---|---|---|
| EP | 2292116 | A1 | 3/2011 |
| JP | 2000197514 | A | 7/2000 |
| JP | 2012157681 | A | 8/2012 |

* cited by examiner

EYELASH CURLER

The present invention relates to an eyelash curler.

An eyelash curler is a device, usually hand-operated, for curling eyelashes for cosmetic purposes.

There is a need in the art for an improved eyelash curler.

According to a first aspect of the present invention, there is provided an eyelash curler comprising an upper section which comprises at least one edge and a lower section which comprises an eyelash support portion, the curler being operable such that eyelashes can be clamped between the edge and the support portion, whereby the edge extends transverse to the eyelashes and engages a top side thereof, and, while the eyelashes remain so clamped, the edge can be drawn, along said top side, substantially in the direction in which each of the lashes extends, whereby the eyelashes are curled upwardly.

In preferred embodiments of the invention, the curler is configured such that the upper and lower sections can be, or are, urged towards each other to effect clamping of the eyelashes between the upper and lower sections. Preferably, the upper and lower sections are interconnected at proximal ends thereof via a hinge about which they can pivot to effect the clamping and release from clamping of the eyelashes. The hinge may be a living hinge which is resiliently deformable.

Preferably, the curler is configured such that the drawing of the or each edge along the top side is in a direction from a proximal end of the eyelashes to a distal end of the eyelashes. It is, however, also possible that the curler may be configured such that the drawing of the or each edge along the top side is in a direction from a distal to a proximal end of the eyelashes.

Preferably, the eyelash curler is a handheld device.

Preferably, the or each edge is movable axially relative to the support portion, whereby the support portion remains substantially stationary with respect to the lashes as the or each edge is drawn along said top side. It is, however, also possible that the curler may be configured so as to be moved in its entirety to effect drawing of the edge along said top side, whereby the eyelashes slip along the support portion, while the eyelashes are clamped; in the curler so configured, the or each edge may be axially fixed relative to the support portion.

In the preferred embodiments of the invention, the upper section comprises a support, preferably in the form of an arm, from which the or each edge is supported movably so as to be able to be drawn along said top side. In the preferred embodiments of the invention, the lower section comprises a support, preferably in the form of an arm, from which the support portion is supported. Preferably, the support portion is fixed relative to the lower section support.

In the curler according to one preferred embodiment of the invention, the upper section has a said edge which can be moved from a start position to an end position, whereby it is drawn along said top side, and thereafter returned to said start position such that movement thereof from the start position to the end position, whereby it is drawn along said top side, is repeatable. The edge may thus be movable in a reciprocating manner to curl the eyelashes. Preferably, in the curler according to this embodiment, the edge is defined by a blade which is movably coupled to the support of the upper section. The blade may be coupled to the upper section support through an axial slot in that support, so as to be movable back and forth along the slot. Preferably, the eyelash curler includes an actuator operable by at least one digit, e.g. a finger or thumb of a person's hand, whereby the movement of the said edge from the start position to the end position and the return of the said edge to the start position is effected.

In the curler according to another preferred embodiment of the invention, the upper section has plural said edges which can be drawn one-after-another along said top side. Preferably, in the curler according to this embodiment, the upper section comprises an element which is configured with said edges arranged circumferentially therearound at spaced apart positions and in substantially parallel relation, and which is mounted to the support of the upper section to be rotatable about an axis which is substantially parallel to the edges. Preferably, said element is manually rotatable. Preferably, the curler is configured such that the rotation can be effected by finger or thumb. Preferably, the rotatable element takes the form of a wheel. Preferably, the rotatable element comprises radially outwardly projecting blades distal ends of which define the, edges. Preferably, the element is rotatable in a direction such that each blade is drawn along said top side in a direction from a proximal end to a distal end of each of the eyelashes.

Preferably, the curler according to this embodiment comprises an, actuator engaged with the rotatable element to effect rotation thereof. Preferably, the actuator forms part of the upper section. Preferably, the actuator is mounted to said support of the upper section. Preferably, the actuator is rotatable and engaged with said element in a manner such that rotation of the actuator imparts rotation to the element. Preferably, the actuator and element are intermeshed such that rotation of the actuator effects rotation of the element. The actuator may comprise radially outwardly projecting fins or paddles arranged so as to mesh with the blades of said element.

Alternatively, the curler according to this embodiment may be configured such that said element can be rotated by being engaged directly by one or more digits on a person's hand.

Preferably, the curler is configured such that a section, rather than the entirety, of the eyelashes along a given eyelid is held between the upper and lower sections.

The or each blade may be defined by a fin or paddle.

Preferably, the edge is relatively sharp.

Preferably, the eyelash support portion comprises a bed arranged such that a bottom side of the clamped eyelashes rests thereagainst. Preferably, the bed is defined by a surface that is curved about an axis which is generally parallel to the edge(s) and thus defines a concavity which receives the clamped eyelashes.

According to a second aspect of the present invention, there is provided a method of curling eyelashes, wherein the eyelashes are clamped between said edge(s) and the support portion of a curler as defined above and one or more said edges is drawn along the topside of the eyelashes.

The present invention will now be described, by way of on-limiting example only, with reference to the accompanying drawings, in which.

Figure 1:
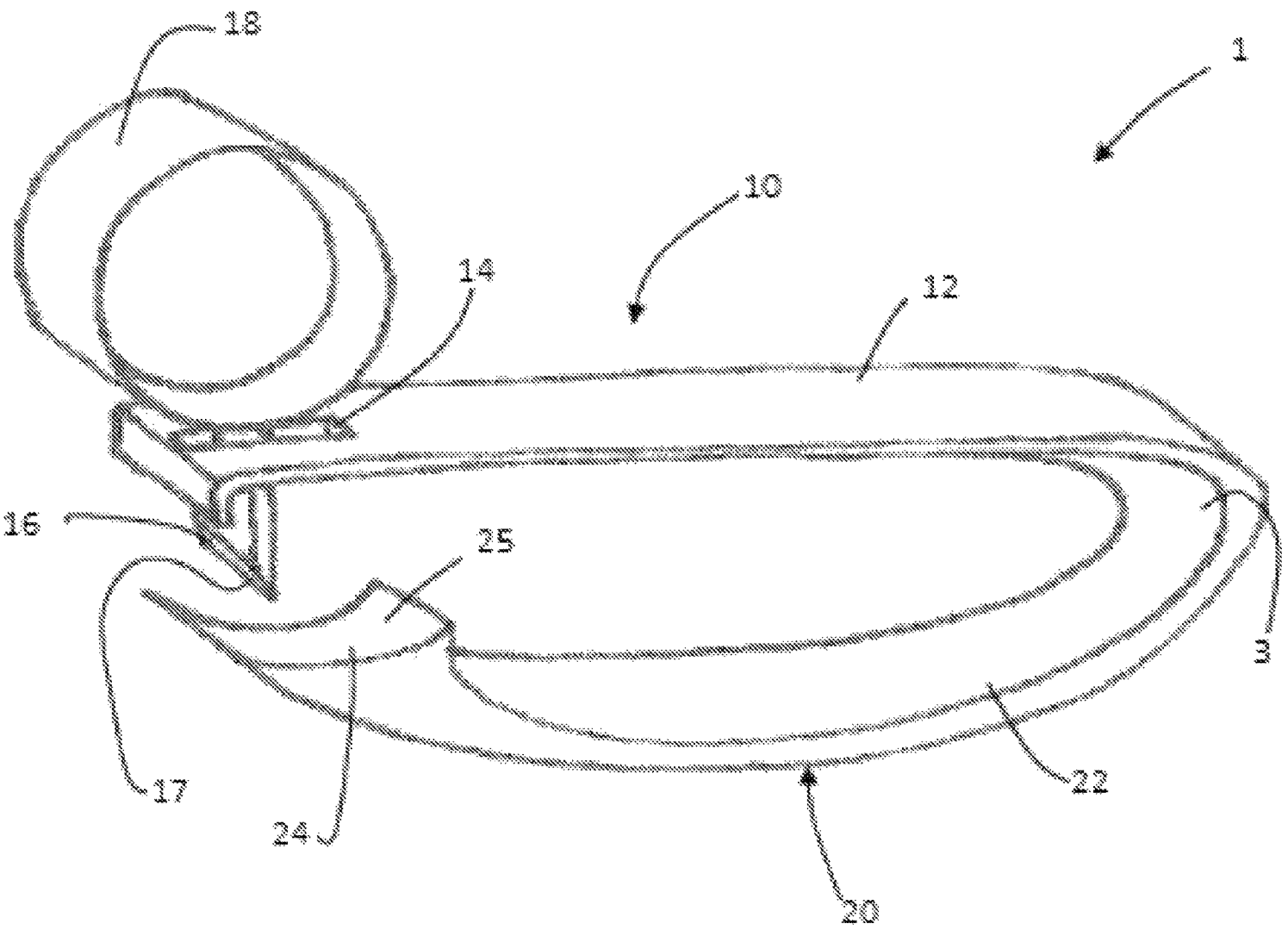
FIG. 1 shows an eyelash curler according to a first preferred embodiment of the invention.

An eyelash curler 1 according to an embodiment of the present invention is illustrated in FIG. 1. The eyelash curler 1 is a handheld device which is manually operable to curl a person's eyelashes. The device 1 comprises opposed upper 10 and lower 20 sections and a living hinge 3 via which those sections are interconnected.

Upper section 10 comprises an arm 12 projecting away from the living hinge 3, a distal end of the arm being configured with an axial slot 14 therethrough, and, received through the slot 14, an assembly comprising a downwardly projecting blade 16, in the form of a fin, defining an eyelash-engaging edge 17 which extends substantially perpendicular to the arm 12, and a ring member 18, attached at a lower end thereof to an upper end of the blade 16 via a narrow interconnection occupying the slot 14, the ring member 18 defining an actuator operable to draw the edge 17 along the top of a section of eyelashes to curl the eyelashes, as will be described in further detail later.

The lower section 20 comprises an arm 22, which projects away from the living hinge 3, below and substantially parallel with the arm 12. The lower section 20 is configured, at a distal end of the arm 22, with an eyelash support portion, in the form of a bed 24 arranged to support an underside of the section of eyelashes as the blade 16 is drawn along them, the bed 24 being curved about an axis parallel to the edge 17 so as to be downwardly concave. The bed 24 provides a curved surface 25 against which the eyelashes rest during operation of the curler 1.

Figure 3:
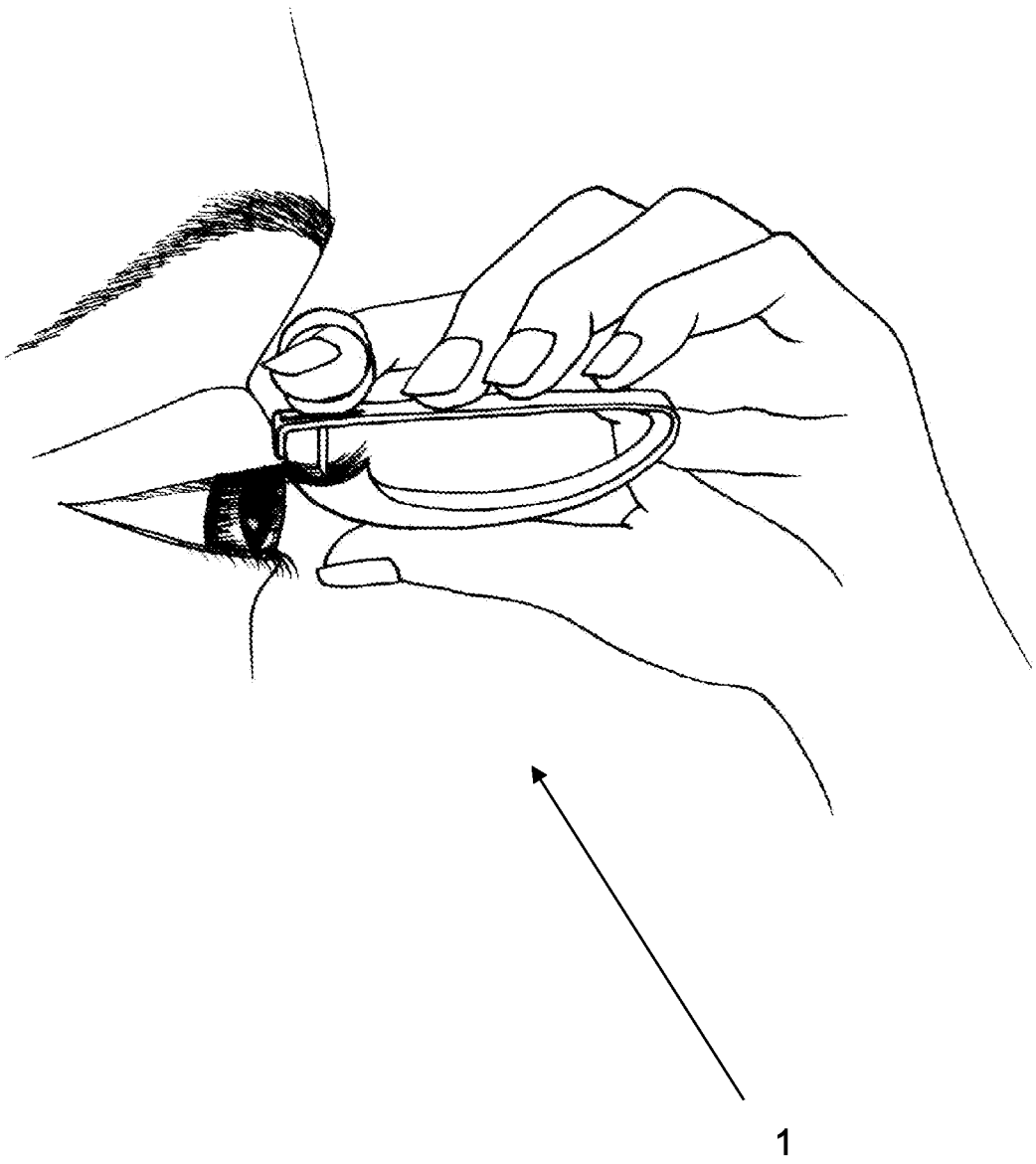
FIG. 3 shows au eyelash curler of the first embodiment in use.

The eyelash curler 1, referring to FIG. 3, is operated as follows. The person holds the curler 1 by its arms 12, 22, positioning it such that the person's eyelashes are received between the bed 24 and blade edge 17, and then urges the arms 12 and 22 towards each other, by pressing them between finger and thumb, so that the eyelashes are held, in a clamped manner, between the edge 17 and bed surface 25. The person then, with a finger or thumb on the other hand inserted through the ring member 18, advances the ring member 18 towards the hinge 3, thereby displacing it and the blade 16 axially along the slot 14, which guides the assembly comprising the ring member 18 and blade 16, towards the hinge 3, whereby the edge 17 is drawn, and more particularly scraped or dragged, along the topside of the eyelashes while they remain clamped between the edge 17 and surface 25. Once the assembly comprising the ring member 18 and blade 16 has reached the end of its stroke in the direction towards the hinge 3, the person stops urging the arms 12 and 22 towards each other, whereby the arms 12, 22 and hinge 3 resile so that the blade 16 and bed 24 are disengaged and the assembly comprising the ring member 18 and blade 16 can be displaced back along the slot 14, in a direction away from the hinge 3, such that it is returned to its start position, whereupon a single cycle of the curler 1 is complete. The person can then again apply pressure to the arms 12 and 22, effecting clamping of the eyelashes between the blade 16 and bed 24, and draw the edge 17 along the topside of the eyelashes as previously described. The configuration and degree of curling can be controlled according to the number of cycles through which the curler 1 is put and the amount of clamping pressure the person imparts to the bed 24 and blade 16 (which pressure could be varied as the blade 16 moves from its start position to its end position).

Figure 2:
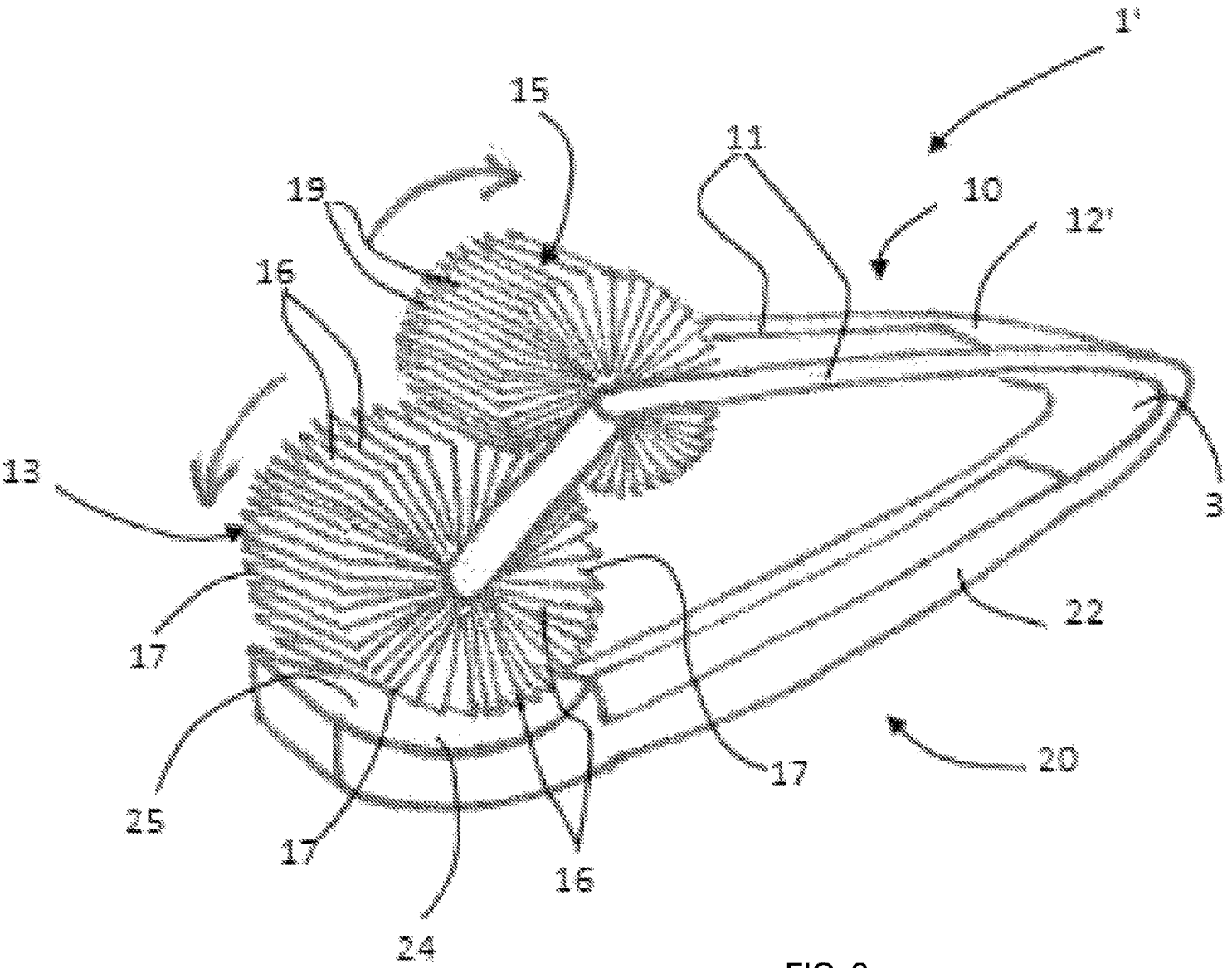
FIG. 2 shows an eyelash curler according to a second preferred embodiment of the invention.

An eyelash curler 1' according to a second preferred embodiment of the invention is shown in FIG. 2. In the description of this embodiment, the same reference numerals as have been used in respect of the first embodiment will be used to denote the same or corresponding features.

The curler 1', like the curler 1, comprises upper 10 and lower 20 sections and a living hinge 3 via which those sections are interconnected. The section 20 in the curler is substantially the same as the section 20 in the curler 1, comprising an arm 22 projecting from the living hinge 3 and being configured, at a distal end of the, arm 22, with a bed 24 defining curved surface 25. The upper section 10 comprises an arm 12' which, like the arm 12, projects away from the hinge 3, above and in general alignment with the arm 22 below it, but, unlike the arm 12, is configured with laterally spaced apart arm sections 11. The upper section 10 includes a wheel 13 which comprises a hub (not shown) and several blades 16, defined by respective fins, which are fixed at proximal ends thereof to the hub and project radially outwardly therefrom whereby distal ends thereof define respective eyelash-engaging edges 17 which are arranged in substantially parallel relation at spaced apart positions circumferentially around the wheel 13. Distal ends of the arm sections 11 are configured with laterally inwardly projecting stub shafts (not shown) which are received in opposite ends of the hub such that the wheel 13 is rotatably supported from the support defined by the arm sections 11 and stub shafts. Each arm section 11 is formed with an elbow such that a distal end section thereof extends towards the distal end of the lower section 20, whereby the wheel 13 is positioned adjacent the bed 24. The upper section 10 additionally comprises an actuator wheel 15 which, like the wheel 13, comprises a hub (not shown) and several blades/fins 19 fixed at proximal ends thereof to the hub and projecting radially outwardly therefrom whereby distal ends thereof define respective edges which are arranged in substantially parallel spaced apart positions circumferentially around the wheel 15. The wheels 13 and 15 are arranged such that distal ends of the blades/fins 16, 19 thereof, within a region generally between the rotational axes of the wheels 13, 15, are in overlapping relation, whereby the wheels 13, 15 are meshed. Accordingly, rotation of the wheel 19, which may be effected by the person's finger or thumb, effects rotation of the wheel 17.

Figure 4:
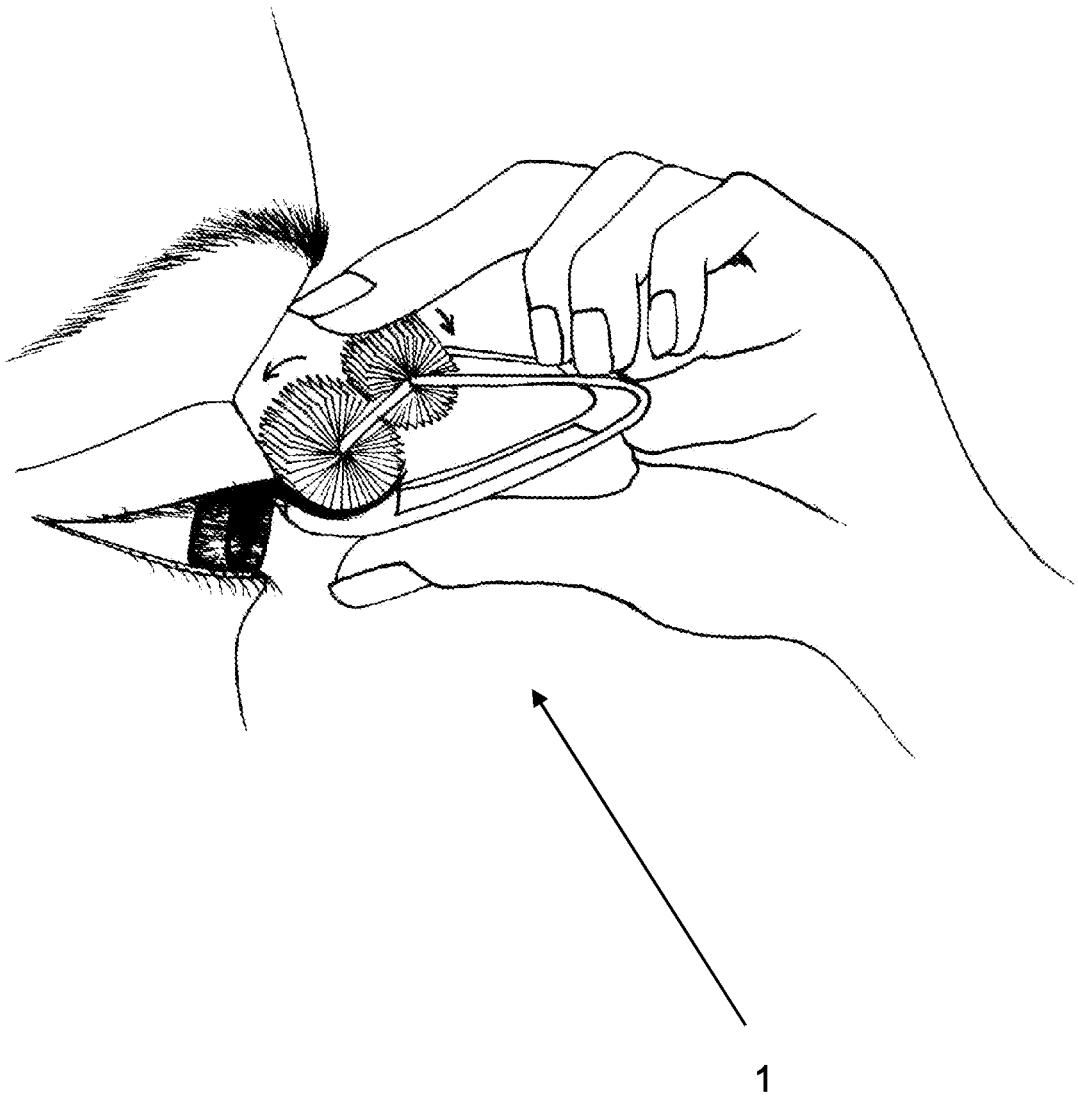
FIG. 4 shows an eyelash curler of the second embodiment in use.

Operation of the curler will now be described, referring to FIG. 4. The person holds the curler 1' by its arms 12', 22, positioning it such that that person's eyelashes are received between the bed 24 and wheel 13, and then urges the arms 12' and 22 towards each other, by pressing them between finger and thumb, so that the eyelashes are held, in a clamped manner, between the bed surface 25 and edges 17 of the wheels 13 which are orientated so as to lie adjacent the bed 24. The person then, with a finger or thumb on the other hand, rotates the wheel 15 in the direction shown in FIG. 2, causing rotation of the wheel 13 in the direction shown in FIG. 2, and thus successive ones of the blade edges 17 to be scraped over the topside of the section of eyelashes received between the bed 24 and wheel 13. It will be appreciated that, in operation of the curler 1', the finger/thumb pressure which urges each successive edge 17 and the bed surface 25 towards each other can be maintained throughout the duration that the section of eyelashes is worked on.

Operation of each of the curlers 1 and 1' curls eyelashes according to essentially the same principle as that via which drawing a transversely orientated blade along a strip of pliable or flexible material, such as paper or ribbon, causes that strip to curl. More particularly, the structural characteristics of the topside of the eyelashes are altered by the edge 17, such that the topside of each eyelash contracts and the eyelash thus bends upwardly.

Each of the devices 1 and 1' may be formed from plastic and/or metal.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments. For example, in relation to the first embodiment, a suitable blade may be movably coupled to the upper arm by any one of numerous alternative means, and, in relation to the second embodiment, it will be appreciated that there may be provided, without departure from the invention, numerous alternative means for imparting rotation to the wheel 13, such as an actuator wheel and a belt via which the actuator wheel is coupled to the wheel 13. Also, the wheel 13 could be replaced by a drum-type wheel configured with teeth or cogs defining the edges 17 in which case the wheel could itself be replaced by a drum-type wheel also formed with cogs, which mesh with the cogs on the driven wheel. Furthermore, the wheel 15 could be omitted, so that rotation of the wheel 13 is instead effected by direct linger or thumb engagement therewith. Moreover, the curlers 1 and 1' are configured to work on only a section of eyelashes on an eyelid at a given time (and to be thereafter advanced sideways along the eyelid to a subsequent section as to work on that section), also possible are embodiments of the invention in which all of the eyelashes on the eyelid are worked on, and thus curled, simultaneously.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. An eyelash curler comprising interconnected lower and upper sections, the lower section comprising a curved bed to support eyelashes, the upper section comprising an arm and a transversely extending blade supported from the arm, the curler being operable to move the upper section toward the lower section, the blade being arranged to projects toward the bed to engage a top side of the eyelashes such that the eyelashes are clamped between the blade and the bed when the upper section is moved toward the lower section, the blade being movably coupled to the arm and thus moveable relative to the bed so as to be operable to scrape along the top side of the clamped eyelashes substantially in a direction from one end of the clamped eyelashes to the other end of the clamped eyelashes while the bed remains substantially stationary to support an underside of the eyelashes, whereby the eyelashes are curled upwardly; further comprising an actuator coupled to the blade and operable to move the blade relative to the arm, and wherein the arm has a slot, and the blade is mounted to the arm in the slot, and the actuator being operable to move the blade back and forth along the slot.

2. A method of curling eyelashes, wherein the eyelashes are clamped between the blade and the bed of a curler according to claim 1 and the blade is moved relative to the bed, so as to be scraped along the top side of the eyelashes, substantially in the direction from one end of the clamped eyelashes to the other end of the eyelashes while the bed remains substantially stationary to support an underside of the eyelashes, whereby the eyelashes are curled upwardly.

3. An eyelash curler according to claim 1, wherein the upper and lower sections are interconnected at proximal ends thereof via a hinge about which the upper section can pivot to effect the clamping and release from clamping of the eyelashes.

4. An eyelash curler according to claim 3, wherein the hinge is a living hinge which is resiliently deformable.

5. An eyelash curler according to claim 1, configured such that the blade is arranged to scrape along the top side in a direction from a proximal end of the eyelashes to a distal end of the eyelashes.

6. An eyelash curler according to claim 1, being a hand-held device.

7. An eyelash curler according to claim 1, wherein the lower section comprises a support from which the bed is supported.

8. An eyelash curler according to claim 7, wherein the support is an arm.

9. An eyelash curler according to claim 7, wherein the bed is fixed relative to the support.

10. An eyelash curler according to claim 1, wherein the curved bed is defined by a surface that is curved about an axis which is generally parallel to the at least one edge and thus defines a concavity to receive the clamped eyelashes.

11. An eyelash curler according to claim 1, wherein the actuator comprises a ring.

* * * * *